US006151806A

United States Patent [19]

Morris et al.

[11] Patent Number: 6,151,806

[45] Date of Patent: Nov. 28, 2000

[54] GRINDING FOOTWEAR APPARATUS INCLUDING PLATE WITH BRAKING SURFACES

[75] Inventors: Christopher H. Morris, Topanga; David G. Inman, Fullerton; Brent James, Manhattan Beach, all of Calif.

[73] Assignee: Artemis Innovations Inc., Torrance, Calif.

[21] Appl. No.: 09/364,756

[22] Filed: Jul. 30, 1999

Related U.S. Application Data

[63] Continuation-in-part of application No. 08/890,595, Jul. 9, 1997, Pat. No. 6,006,451, which is a continuation-in-part of application No. 08/799,062, Feb. 10, 1997, Pat. No. 5,970, 631.

[60] Provisional application No. 60/022,318, Jul. 23, 1996.

[51] Int. Cl.[7] ..... A43B 23/00; A43B 5/04

[52] U.S. Cl. ..... 36/136; 36/107; 36/115; 36/25 R

[58] Field of Search ..... 36/132, 115, 114, 36/107, 72 A, 73, 108, 25 R, 148, 149, 152, 103, 116, 133, 136, 7.1 R, 76 C, 72 R, 72 B, 75 R, 75 A, 82; 280/11.23, 11.27, 842, 11.28, 293, 809, 811

[56] References Cited

U.S. PATENT DOCUMENTS

| | | | |
|---|---|---|---|
| 234,030 | 11/1880 | Hadley . | |
| D. 404,550 | 1/1999 | James | D2/960 |
| D. 412,779 | 8/1999 | James | D2/957 |
| 579,577 | 3/1897 | Hanscom . | |
| 702,476 | 6/1902 | Price . | |
| 875,560 | 12/1907 | Vaughn . | |
| 881,079 | 3/1908 | Jolitz . | |
| 892,152 | 6/1908 | Harman . | |
| 1,051,880 | 2/1913 | Glenn . | |
| 1,056,091 | 3/1913 | Dickson . | |
| 1,189,329 | 7/1916 | Winagle . | |
| 1,260,901 | 3/1918 | Hayhurst . | |
| 1,428,232 | 9/1922 | Holmen . | |
| 1,592,692 | 7/1926 | Hackett . | |
| 2,484,935 | 10/1949 | De Rooy . | |
| 2,572,671 | 10/1951 | Shaw . | |
| 3,486,250 | 12/1969 | Purtle . | |
| 4,947,560 | 8/1990 | Fuerst et al. . | |
| 5,319,866 | 6/1994 | Foley . | |
| 5,410,821 | 5/1995 | Hilgendorf . | |
| 5,425,186 | 6/1995 | Hoyt . | |
| 5,682,685 | 11/1997 | Terlizzi . | |
| 5,716,723 | 2/1998 | Van Cleef et al. . | |
| 5,836,591 | 11/1998 | Roderick et al. | 280/11.22 |
| 5,967,552 | 10/1999 | Roderick et al. | 280/843 |
| 6,006,450 | 12/1999 | Hayes | 36/107 |

FOREIGN PATENT DOCUMENTS

| | | |
|---|---|---|
| 296 13 508 U1 | 11/1996 | Germany . |
| PCT/US97/11652 | 7/1997 | U.S. . |
| PCT/US97/11973 | 7/1997 | U.S. . |
| 117176 | 7/1918 | United Kingdom . |
| 216903 | 1/1925 | United Kingdom . |

*Primary Examiner*—Paul T. Sewell
*Assistant Examiner*—Anthony Stashick
*Attorney, Agent, or Firm*—Fulwider Patton Lee & Utecht, LLP

[57] ABSTRACT

A grinding shoe apparatus for both normal running and walking activity and including a sole cavity for mounting a complementary plate configured with a plurality of bearing surfaces for sliding along rigid support surfaces and braking surfaces to control speed developed while sliding.

36 Claims, 3 Drawing Sheets

GRINDING FOOTWEAR APPARATUS INCLUDING PLATE WITH BRAKING SURFACES

This application is a continuation-in-part of U.S. patent application Ser. No. 08/890,595, filed Jul. 9, 1997 now U.S. Pat. No. 6,006,451 which was a Continuation-in-Part of Ser. No. 08/799,062, filed Feb. 10, 1997, now U.S. Pat. No. 5,970,631 claiming priority of Provisional Application 60/022,318 filed Jul. 23, 1996, all of which are incorporated herein by reference.

BACKGROUND OF THE INVENTION

1. Field of the Invention

The present invention relates to articles of footwear adapted to support the traditional functions of footwear as well as to facilitate sliding over, for instance, a pipe rail, curb, an edged surface or the like.

2. Description of the Prior Art

Athletes donning in-line skates or riding skateboards and leaping onto curbs, rails, or other manmade obstacles to contact the metallic or wooden surface of the skate or skateboard with the curb and sliding therealong has come to be known as "grinding". The continued increase in popularity of grinding has led to a demand for athletic shoes incorporating a plate for performing similar and novel sliding maneuvers over rigid support surfaces commonly found outdoors in a variety of places such as parking lots and walkways as well as those built at manmade skate parks. Examples of such devices can be seen in our earlier application U.S. Ser. No. 08/890,595, filed Jul. 9, 1997, now U.S. Pat. No. 6,006,451 and sold under the to brand name of SOAP®. Generally, the SOAP® brand shoes enable normal walking and running functions while incorporating a plate recessed upwardly from the bottom surface of the shoe sole for grinding along the rigid support surfaces as provided by pipe railings, curbs, and similar objects.

While the above referenced apparatus has enjoyed considerable commercial success, athletes continue to demand additional features and or performance from their grinding equipment. One such feature commonly demanded is speed control. This feature is generally useful in performing some advanced grinding maneuvers but is particularly in demand for beginners who lack experience in handling the speed that can be generated during grinding especially on steeper grades. While an example of a grinding shoe apparatus that attempts to deal with this problem can be found in U.S. Ser. No. 09/132,838, filed on Aug. 12, 1998, now U.S. Pat. No. 6,006,450, this device incorporates a wear resistant tab secured between the upper and the plate and having abrasive surfaces to enable the grinder to roll over the shoe and contact the rail to slow down the speed of the slide. This device is primarily for protecting the upper against excessive wear and may require a significant amount of rolling prior to engagement with the support surface to provide a braking function.

Other features commonly demanded are lighter equipment and for a large segment of the population just starting out, stability is preferred over maneuverability until some experience is gained.

What is needed and heretofore unmet by current grind wear, is a grinding shoe that meets the demands of athletes insisting on speed control features, overall lighter weight shoes, and enhanced stability.

SUMMARY OF THE INVENTION

The grinding apparatus of the present invention is generally characterized by a shoe sole having a body formed with cavity of a predetermined configuration recessed upwardly therein and an elongated slide plate configured with a top wall to complement such predetermined configuration. The slide plate includes a bottom portion formed with at least one bearing surface having a relatively low coefficient of friction and at least one side portion configured with a braking surface having a relatively high coefficient of friction for resisting sliding movement along the support surface. The plate is configured such that a transition from sliding to braking is accomplished by merely a slight roll of the shoe.

Another feature of the present invention is the incorporation of differing densities or hardnesses between the top and bottom portions to exhibit different frictional resistances to facilitate both sliding and braking actions.

The present invention may also incorporate different colored portions to indicate the necessity of replacement of the grinding plate due to prolonged use.

Other features and advantages of the present invention will become more apparent from the following detailed description of the invention, when taken in conjunction with the accompanying exemplary drawings.

Numerous advantages and aspects of the invention will be apparent to those skilled in the art upon consideration of the following detailed description which generally provides illustrations of the invention in its presently preferred embodiments.

DETAILED DESCRIPTION OF THE PREFERRED EMBODIMENT

Referring now to FIGS. 1–6, a shoe apparatus, generally designated 20, is provided for performing sliding or grinding maneuvers along rigid support surfaces such as curbs, pipe rails, or specially made obstacles provided in skate parks. While the figures are generally directed to a right shoe, it will be appreciated that these principles apply equally to the left shoe as well. The shoe apparatus includes generally, a shoe sole 22, configured for receipt of an elongated slide plate 24 constructed to provide both sliding and braking functions while contacting the support surfaces.

Figure 1:
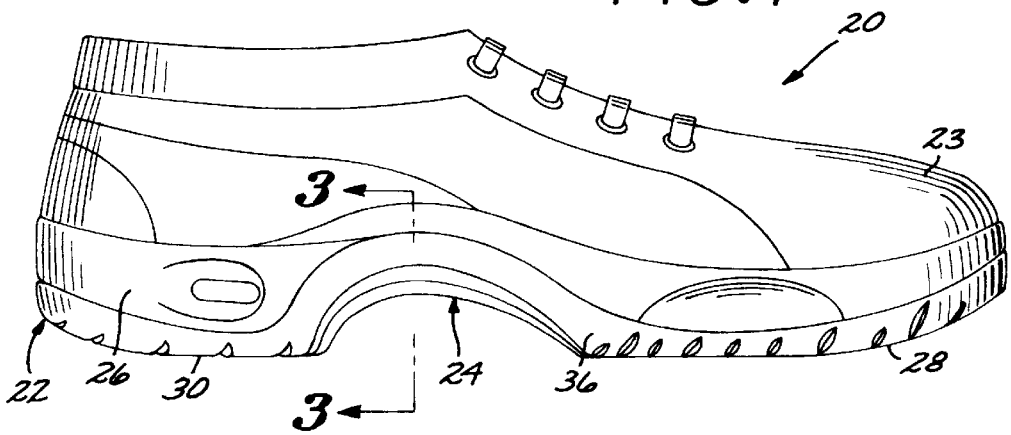
FIG. 1 is a lateral side view of a first embodiment of the present invention incorporating a plate with sliding and braking surfaces mounted to the sole.
Figure 2:
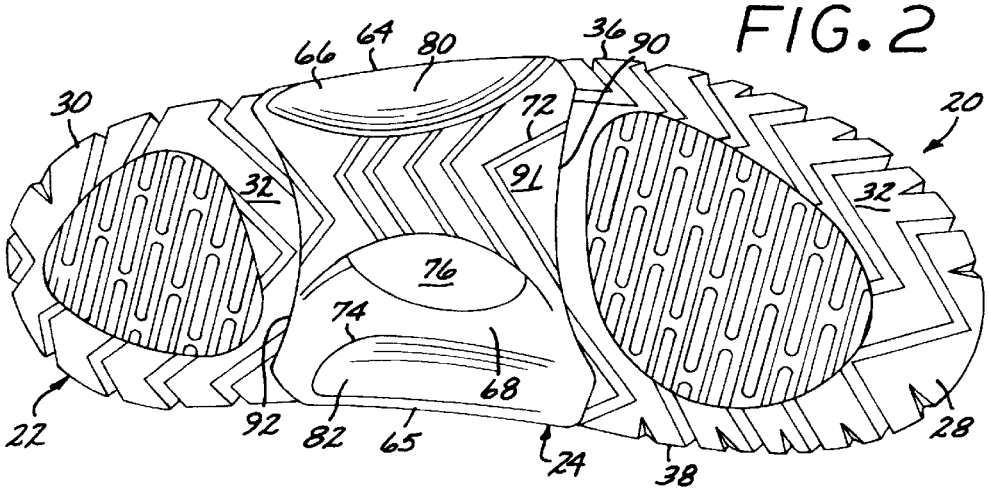
FIG. 2 is a bottom view of the embodiment shown in FIG. 1.
Figure 3:
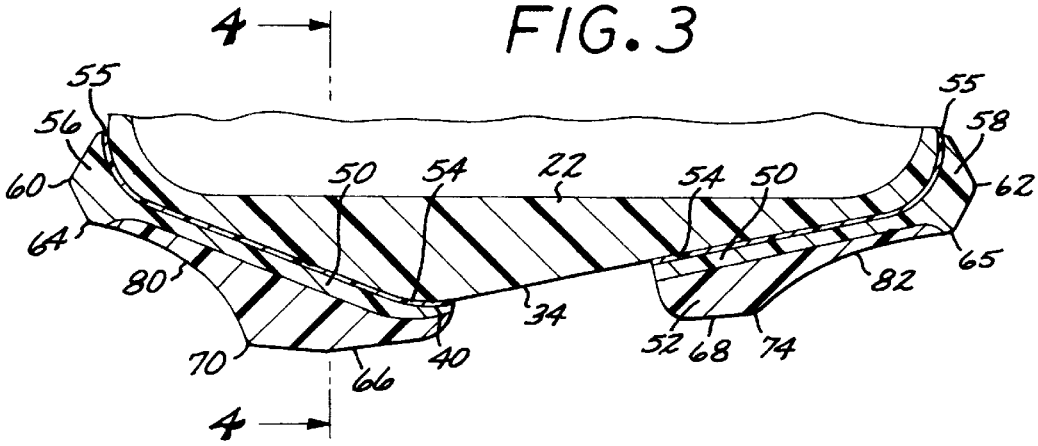
FIG. 3 is a lateral cross sectional view, in enlarged scale, taken along lines 3—3 as shown in FIG. 1.
Figure 4:
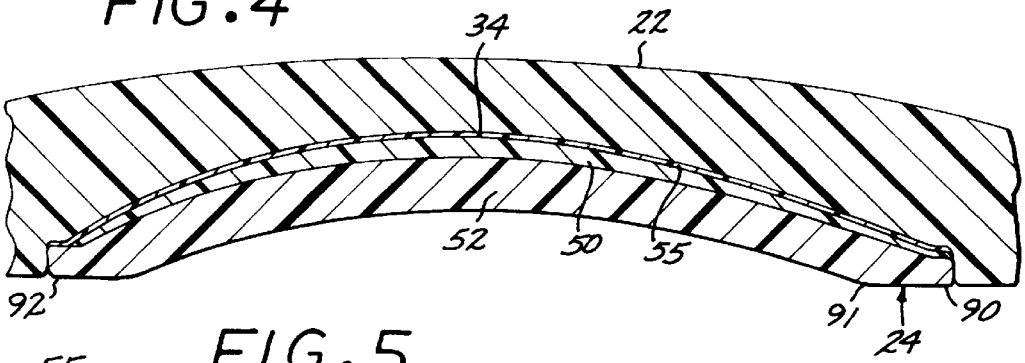
FIG. 4 is a longitudinal cross sectional view of the first embodiment taken along lines 4—4 of FIG. 3.

The sole 22 is attached to a conventional upper 23 by methods well known to those of ordinary skill in the art and consists of a sole body 26 including a spaced apart forefoot region 28 and heel region 30 each terminating at their respective lower extent in a high friction tread surface 32. Between the forefoot and heel regions and substantially within the arch area of the shoe is an upwardly recessed wall 34 forming a cavity in the sole body. The cavity is generally pre-formed during the molding process of the sole with a preferable height above a horizontal plane passing through the tread surface that enables the lowermost extent of the plate 24 to be recessed above this horizontal plane. Consequently, the installed plate will not interfere with normal shoe functions such as walking and running. The cavity spans the width of the shoe from a lateral side 36 of the sole to a medial side 38 of the sole and also projects longitudinally within the arch area. Portions of the cavity project upwardly along the medial and lateral sides of the shoe to receive portions of the plate which wraps up onto the sides of the sole body. The cavity is generally arcuately shaped when viewed in longitudinal cross section. As shown in FIG. 3, the cavity wall varies in depth across the sole. The cavity wall is recessed higher into the sole body at the lateral and medial sides of the sole and converges to a low point 40 positioned between the central longitudinal axis of the shoe and the lateral side of the sole. In other words, the low point of the cavity wall is slightly off-center and positioned closer to the lateral side or outside of the shoe. It will also be appreciated that the cavity could run generally longitudinally from the heel to the toe of the shoe and incorporate a plate therein for sliding along a direction of the cavity. Other cavity shapes will also be apparent to those of ordinary skill in the art and not detract from the scope of the present invention.

The sole is generally formed of an elastomeric material or from a urethane-based substance commonly used in the industry. It is to be appreciated that other materials well known in the industry may also be used. However, as explained further below, it is preferable to use materials to form the outside surface in the cavity wall to provide for a high bond strength with the plate.

The elongated slide plate 24 is generally a unitary body comprising a top portion 50 overlying a bottom portion 52. Several functions are accommodated by the structure of the top portion of the plate. The plate is typically molded from a rigid plastic and constructed to abut the cavity wall and the top portion includes an upper surface 54 configured to complement the configuration of the cavity wall 34 so that the plate nests directly against the cavity wall. It will be appreciated that while mechanical fasteners may be used such as the threaded fasteners and other fasteners disclosed in the applications referenced above and incorporated by reference herein, it is preferable to use a bonding agent 55 such as urethane to secure the plate to the sole. This further lightens the overall weight of the grinding apparatus by omitting the use of the mechanical fasteners or anchor plate and simplifies the molding process of both the plate and the sole. It is also preferable that the top portion is formed of a urethane based material in order to create a stronger bond with the urethane or elastomeric sole. Other bonding agents or adhesives that are well known in the industry may also be used provided that they can withstand repeated impact from use whether walking, running, and initially contacting the support surfaces with the plate as well as the lateral forces induced during grinding and braking.

The top portion 50 extends across the width of the shoe and includes flanking lateral 56 and medial 58 side portions that extend laterally outwardly beyond the sides of the sole about 5–10 mm on each side. This provides a wider base for added stability which increases in importance during the early development of the grinder. Each respective side portion includes a lateral side rail 60 and medial side rail 62. The rails project upwardly to provide lateral support to the wearer and during braking carry at least some of the weight of the athlete. The rails are also bowed outwardly along the centerline and generally arcuate when viewed in longitudinal cross section. The cantilever of each rail divides upper and lower faceted portions that are generally about 10 mm in height along a substantial length of each rail to converge at the forward and rearward extremities of the plate. Each respective rail includes an apex positioned slightly behind the lateral centerline of the plate 24. While the wearer may slide on the faceted portions, the lower extremities of the respective lower faceted portions incorporate respective lateral and medial braking edges 64 and 65 that are more abrasive, roughened, or formed of a softer material having a lower density than the other portions of the plate to form a high coefficient of friction surface. Contact between either rail braking edge and the support surface inhibits the sliding motion of the plate over the support surface. Consequently, the athlete may control the speed of the slide by applying a greater or lesser normal force upon the pipe through the braking edge being applied.

The bottom portion 52 of the plate 24 includes primary 66 and secondary 68 longitudinally projecting bearing surfaces for slidable engagement with the support surface and bearing the weight of the athlete. The bottom portion is preferably formed from a high density thermoplastic urethane to resist wear due to sliding over support surfaces. The primary bearing surface is disposed closer to the lateral side of the shoe and abuts the low point 40 of the cavity wall. This bearing surface 66 is about 55 mm wide at its narrowest point in the center and flares laterally outwardly in the forward and rearward directions. A substantially flattened surface is formed on the bottom of the primary bearing surface with a modicum of curvature in the longitudinal plane for placement on the support surface to slide thereal-long. The primary bearing surface terminates in an outwardly concave outside edge or track 70 that defines the outermost sliding surface. A plurality of grooves 72 or other surface design matching the tread surface design may be molded into the primary bearing surface to enhance the aesthetics of the plate.

Spaced apart from the primary bearing surface 66 and disposed between the medial side 58 of the plate 24 and the central longitudinal axis is the secondary bearing surface 68 having a narrow central strip about 10 mm wide with forwardly and rearwardly flared regions. The secondary bearing surface also includes a outwardly concave outermost edge or track 74 that defines the outermost, medial side, sliding surface. The secondary bearing surface is raised 3–5 millimeters higher from the tread surface than the primary bearing surface to more closely resemble the arch of the wearer's foot. The athlete may use this surface for sliding or as the individual's skill progresses may rely solely on the primary bearing surface for sliding maneuvers.

The bottom surface of the plate is broken by a longitudinally extending, centrally located, substantially elliptically-shaped lightening aperture 76 which separates the two bearing surfaces and projects through the plate 24. The elliptical shape is substantially flattened on opposing transverse sides and converges on its longitudinal ends to respective pointed arches defined by the converging outwardly flaring portions of the primary 66 and secondary 68 bearing surface.

Figure 7:
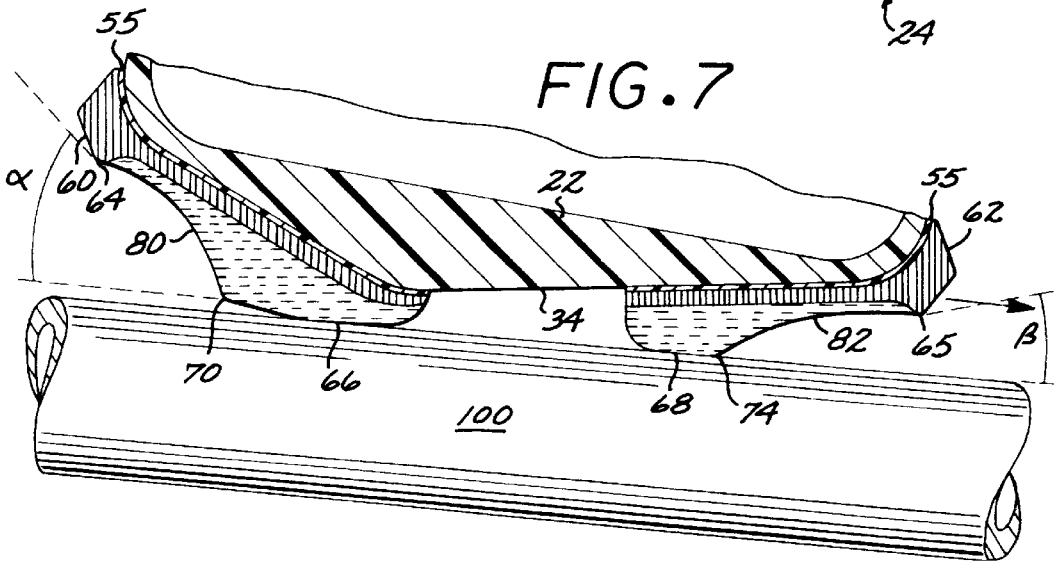
FIG. 7 is a view similar to that shown in FIG. 5 depicting the present embodiment translating over a rail.

To further understand the structure of the present embodiment, a pair of longitudinally projecting lateral 80 and medial 82 elliptically shaped scallops are recessed upwardly and inwardly into the plate 24 to face laterally outwardly and downwardly. The lateral recess 80 separates the curved outermost bearing edge 70 of the primary bearing surface 66 to define a bearing rail spaced laterally from the lateral rail braking edge 64. This lateral separation is generally about three-quarters of an inch over a two inch length with such bearing and braking rails curving gradually toward one another as they extend forwardly and rearwardly at the respective forward and rearward extremities. From a horizontal plane passing through the bearing rail of the primary bearing surface, the lateral braking edge is elevated upwardly and spaced outwardly about ¾ inch from the bearing edge 70 resulting in about a 35–45 degree angle, indicated by angle alpha (FIG. 7). The medial recess 82 separates the curved outermost edge 74 defining a bearing rail or track on the secondary bearing surface 68 from the medial rail braking edge 65 and assumes a similar shape to the lateral recess. This recess 82 is about one inch wide at the point of greatest separation which projects over a two inch span. The medial braking edge 65 is spaced upwardly and outwardly about an inch from the track 74 resulting in an angle of about 10–20 degrees as measured from the horizontal plane passing through the track 74 of the secondary bearing surface as indicated at angle beta (FIG. 7). The combination of the distances between the respective braking edges 64 and 65 and the lateral or medial tracks and angles at which the brakes are elevated enhances the transition from sliding to braking with minimal exertion by the wearer on the medial side to slightly more rolling distance required on the lateral side to accommodate the mechanics of the wearer's ankle. The different elevations of the braking edges further assists braking along support surfaces having a variety of inclinations while providing clearance for sliding when the brakes are not engaged. Other angles could also be used for surfaces that are flatter or steeper than generally encountered in typical grinding environments. It will further be appreciated that removal of plate material from the lightening aperture 76 and lateral and medial recesses produces a lighter plate.

The forward edge 90 and rearward edge 92 of the plate 24 are concave when viewed from the respective forefoot 28 and heel 30 region. Larger in width than the rearward edge, the forward edge and area immediately proximate may form a flex region 91 constructed to be flexible so that when the sole 22 flexes during normal walking and running activities separation is completely inhibited or reduced so as to inhibit entry of debris such as small pebbles between the plate and the sole.

It will also be appreciated that the top portion 50 is preferably different in color than the bottom portion 52. This feature indicates to the user that the bottom portion, which is subject to wear from the grinding action over the rails, curbs, and like obstacles has worn down to the top portion and the plate needs to be replaced.

Figure 8:
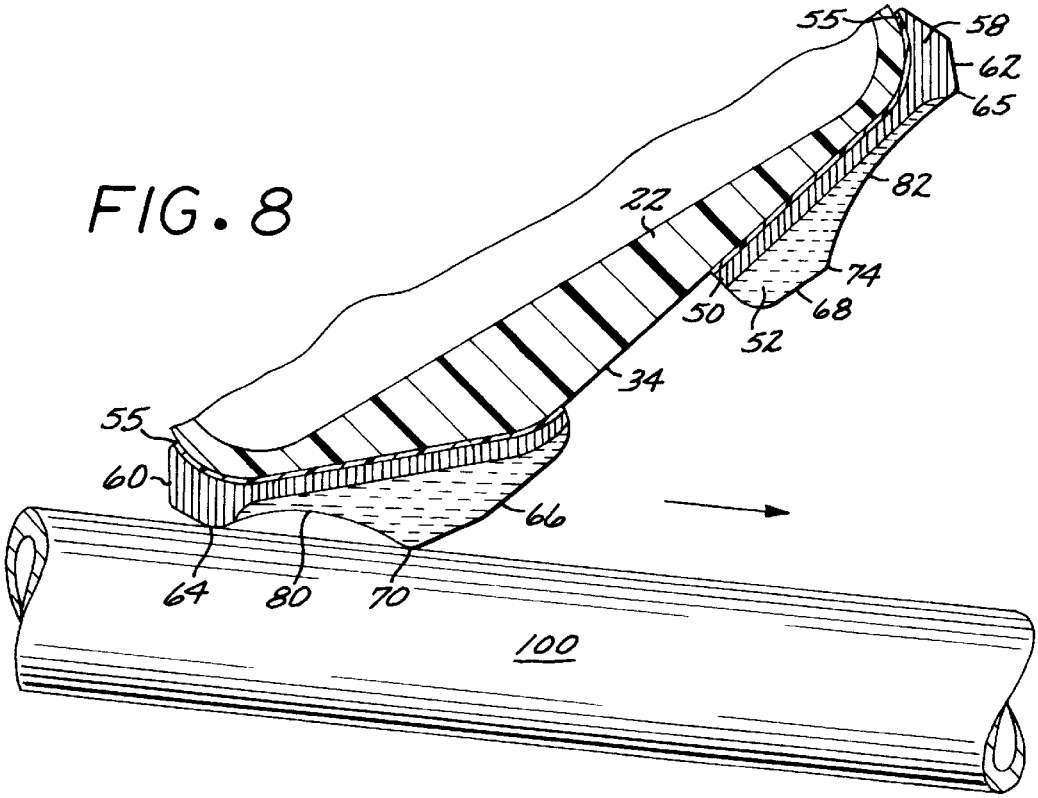
FIG. 8 is a view similar to that shown in FIG. 5 depicting the present embodiment engaged in braking along the rail.

Referring now to FIGS. 7–8, in operation, the wearer may don a pair of grinding shoes 20 embodying in the present invention. The wearer or "grinder" may then walk or run about in a normal manner without the plate contacting the underlying sidewalk or arena floor. When a grinding site such as a pipe 100, curb edge, or other manmade obstacle of choice is selected, the grinder may jump onto the rail to contact the primary 66 and secondary 68 bearing surfaces with the rail and slide therealong in a direction transverse to the shoe using gravity or momentum (FIG. 7). It will appreciated that the wearer may slide in either transverse direction and upon gaining experience may balance only on the primary bearing surface. It is also worthy of note that the broad base and lateral support provided by the top portion and rails provides enhanced stability and enables beginners to get a better "feel" for using the shoes prior to performing more skillful maneuvers.

While sliding over the rigid support surface, especially those with steeper inclines, the grinder may experience speed that is either uncomfortable, undesirable for a subsequent maneuver, or necessary to reduce for safety reasons. As depicted in FIG. 8, the athlete may easily roll one or both feet around a axis substantially perpendicular to the direction of travel and provide a braking action induced by contacting the selected lateral 64 or medial 65 braking edge with the rail. For purpose of this illustration, the action of one grinding shoe apparatus will be described. The wearer is initially in sliding position with the full face of the primary bearing surface 66 contacting the pipe 100. As the wearer initiates a rolling action toward, for example, the lateral side 36 of the shoe, the contact area between the primary bearing surface 66 and the pipe 100 is reduced and grinder is essentially sliding along the outermost edge 70 of the primary bearing surface. Continuing with the rolling action in the same direction, the surface engaging the pipe becomes the outermost edge of the primary bearing surface and the braking edge 64 of the lateral rail 60. Due to the abrasive character or relative softness of the rail, a frictional force is exerted and sliding motion along the pipe is resisted. The wearer has control over the braking function by applying more weight or normal force over the braking edge. It will be appreciated that the wearer may roll the foot in the opposite direction to engage the braking edge 65 of the medial rail. It can further be appreciated that the due to the proximity of the braking edges 64 and 65 to the respective bearing surfaces 66 and 68 a minimal amount of rolling action is needed to access the brakes. While sliding, the athlete may easily alternate brakes on either shoe, use brakes on both shoes, or selectively use only one brake as desired.

Figure 5:
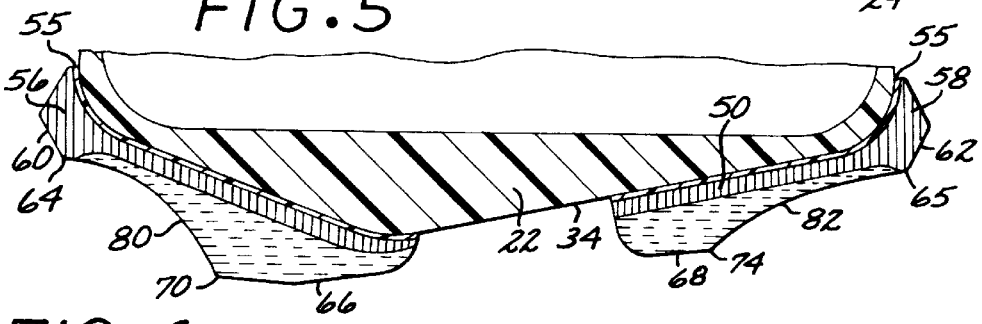
FIG. 5 is a lateral cross sectional view similar to that shown in FIG. 3 indicating the dual color nature of this embodiment.
Figure 6:
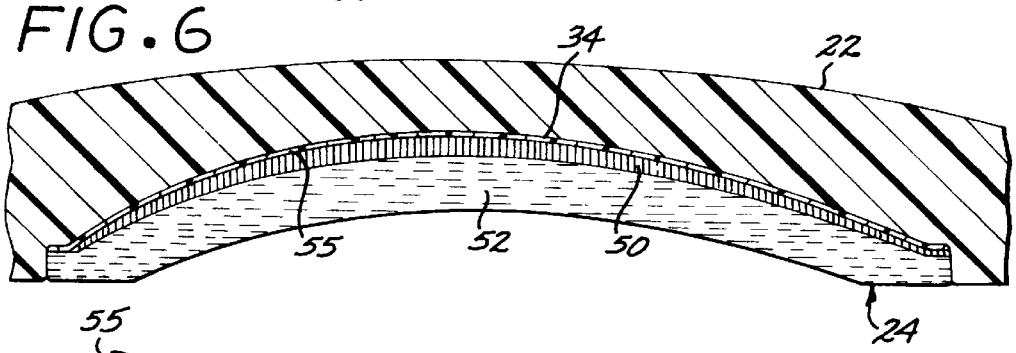
FIG. 6 is a longitudinal cross sectional view similar to that shown in FIG. 4 showing the dual color nature of this embodiment.
Figure 9:
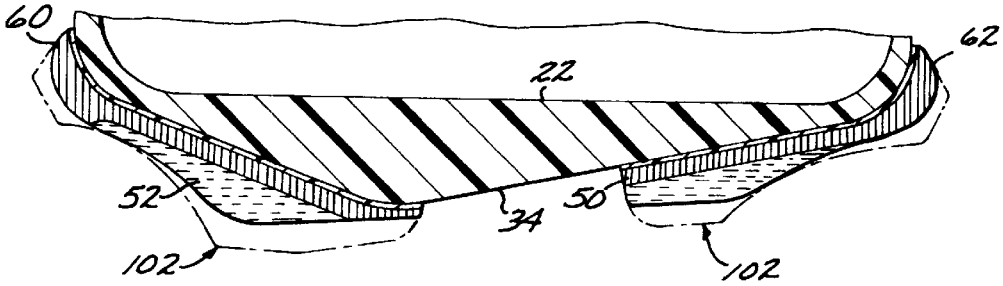
FIG. 9 is a view similar to that shown in FIG. 5 depicting the first embodiment worn down at the main bearing and braking surfaces.
Figure 10:
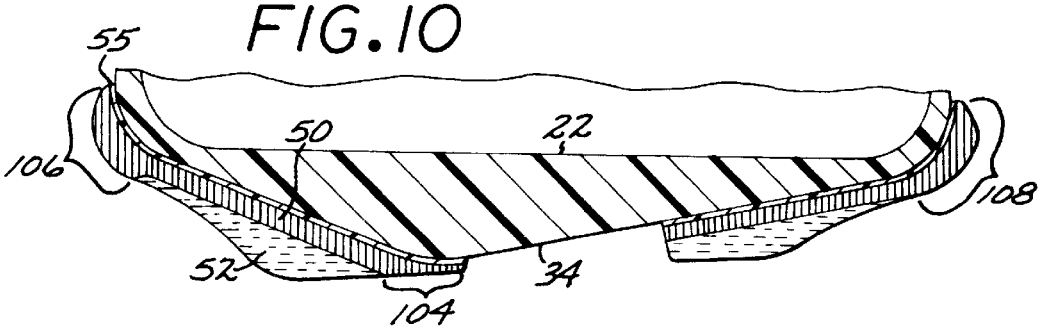
FIG. 10 is a view similar that shown in FIG. 9 wherein the top portion wear indicator is exposed due to abrasion of the lower surface.

It will be appreciated that after extended use, the bottom portion 52 of the plate 24 and rails 60 and 62 may eventually wear through. As shown in FIGS. 9–10, the original surface, generally indicated by phantom lines 102, and worn surfaces are depicted. Referring also to FIGS. 5–6, the color separation is indicated between the top and bottom portions prior to initial use. Once the bottom portion is worn through, the top portion 50 will be exposed, as indicated at 104, and due to the difference in color, the wearer will be notified that it is time to replace plate. The lateral 60 and medial 62 rails are preferably made with a thickness to withstand a lot of braking activity. However, prolonged activity and braking will eventually wear these regions down as indicated respectively by wear spots 106 and 108. This feature thus affords the user a wear indicator alerting such user of the fact that it is time to replace the plate as by acquiring a new pair of grinding shoes. While the plate will operate satisfactorily without this feature, the wear indicator further enhances the safety features of the shoe apparatus.

While several forms of the present invention have been illustrated and described, it will also be apparent that various modifications may be made without departing from the spirit and scope of the invention. For instance, it will be appreciated that differing densities or hardnesses, could be used in the top and bottom portions as demanded by the marketplace. For example, if only a minimum amount of braking is needed, the top portion may be significantly harder or the rails less abrasive. If more braking action is required, then softer materials may be used in the top portions such as elastomeric materials to enhance the frictional resistance when the brakes are applied. Different top surfaces for use with particular bonding agents could also be substituted and be within the scope of the present invention.

What is claimed is:

1. Shoe apparatus for performing sliding maneuvers over an elongated support surface comprising:

a sole including a body configured in the arch area with an upwardly recessed wall forming a cavity of a predetermined configuration;

an elongated slide plate having a top portion including an upper surface configured to complement said predetermined configuration to nest against said wall, a bottom portion including a substantially centrally disposed bearing surface having a relatively low coefficient of friction for slidably engaging the support surface, and at least one braking portion including a braking surface having a relatively high coefficient of friction to frictionally engage said support surface, said plate being fastened to said sole whereby said shoe may be driven onto said support surface to engage said bearing surface against said support surface to slide therealong and said shoe then maneuvered to engage said braking surface with said support surface.

2. Shoe apparatus as set forth in claim 1 wherein:

said plate is formed on its opposite sides with respective longitudinal support rails and longitudinal braking rails spaced upwardly and outwardly from said bearing surface.

3. Shoe apparatus as set forth in claim 1 wherein:

said top portion is formed with a first hardness less than a second hardness of said bottom portion.

4. Shoe apparatus as set forth in claim 1 wherein:

said top portion overlies said bottom portion and is constructed with a different color than said bottom portion to provide a wear indicator showing when said bottom portion wears through.

5. Shoe apparatus as set forth in claim 1 that includes:

an adhesive bonding for fastening said plate to said sole.

6. Shoe apparatus as set forth in claim 1 wherein:

said sole is constructed of an elastomeric material and said adhesive includes urethane.

7. Shoe apparatus as set forth in claim 1 wherein:

said side portion is formed on the lateral side of said plate and includes a scalloped region.

8. Shoe apparatus as set forth in claim 1 wherein:

said side portion is formed on the medial side of said plate and includes a scalloped region.

9. Shoe apparatus as set forth in claim 1 wherein:

said plate includes a lateral side portion and a medial side portion, said side portions including respective scalloped regions defining said braking surfaces at an outermost extent of respective said scalloped regions.

10. Shoe apparatus as set forth in claim 9 wherein:

an angle between said lateral braking surface and a horizontal plane passing through said lateral bearing rail is about 35–45 degrees.

11. Shoe apparatus as set forth in claim 9 wherein:

an angle between said medial braking surface and a horizontal plane passing through said medial bearing rail is about 10–20 degrees.

12. Shoe apparatus as set forth in claim 8 wherein:

said scalloped regions are inwardly concaved and generally elliptically shaped to form carrier and internal rails spaced apart in the longitudinal center of said sole and converging together at the forward and rearward extremities.

13. Shoe apparatus as set forth in claim 1 wherein:

said top portion is constructed of urethane.

14. Shoe apparatus as set forth in claim 1 wherein:

said sole is constructed of urethane.

15. Shoe apparatus as set forth in claim 1 wherein:

said side portion includes a rail having an outwardly facing surface with a coefficient of friction higher than said low coefficient of friction of said bearing surface.

16. Shoe apparatus as set forth in claim 15 wherein:

said plate includes a pair of elongated, flattened, bearing surfaces flanking said recess.

17. Shoe apparatus as set forth in claim 1 wherein:

said plate includes a pair of slide rails flanking either side of said plate and extending laterally outwardly beyond the lateral sides of said sole, said rail further including outwardly facing surfaces comprising braking surfaces.

18. Shoe apparatus as set forth in claim 17 wherein:

a respective central portion of said rails is bowed outwardly.

19. Shoe apparatus as set forth in claim 17 wherein:

said rails project outwardly beyond said lateral sides of said sole about 6 mm.

20. Shoe apparatus as set forth in claim 1 wherein:

said plate includes a centrally disposed lightening aperture.

21. Shoe apparatus as set forth in claim 20 wherein:

said aperture is substantially elliptically shaped.

22. Shoe apparatus as set forth in claim 1 wherein:

a forward portion of said plate is formed with a flex region constructed to flex with said sole.

23. Shoe apparatus as set forth in claim 1 wherein:

said bearing surface includes a plurality of grooves.

24. Shoe apparatus as set forth in claim 1 wherein:

said bearing surface includes a primary bearing surface and a secondary bearing surface that is narrower in width than said primary bearing surface.

25. Shoe apparatus as set forth in claim 24 wherein:

at least one bearing surface is positioned between a central longitudinal axis of said plate and a lateral side of said plate.

26. Shoe apparatus as set forth in claim 24 wherein:

at least one bearing surface is positioned between a central longitudinal axis of said plate and a medial side of said plate.

27. Shoe apparatus as set forth in claim 24 wherein:

said secondary bearing surface is recessed higher into said cavity than said primary bearing surface.

28. Shoe apparatus as set forth in claim 1 wherein:

said plate is arcuate in cross section when viewed in a longitudinal plane.

29. Shoe apparatus as set forth in claim 1 wherein:

said upper surface of said plate is saddle shaped.

30. Shoe apparatus as set forth in claim 1 wherein:

said sole includes a lowermost extent defining a tread surface and said plate is elevated above said tread surface.

31. Shoe apparatus as set forth in claim 1 wherein:

said bottom portion is constructed of a high density urethane.

32. Shoe apparatus as set forth in claim 1 wherein:

a forward edge is concave and is greater in width than a trailing edge of said plate.

33. Shoe apparatus as set forth in claim 1 wherein:

said sole body is formed with said cavity running laterally under the arch; and said plate is generally saddle shaped and extends under said arch.

34. Shoe apparatus as set forth in claim 1 wherein:

said plate is configured with a downwardly opening trough.

35. Shoe apparatus as set forth in claim 34 wherein:

said plate is configured with the lowermost portion raised above the plane of the bottom surface of said sole.

36. Grinding apparatus for performing sliding maneuvers over a rigid support surface comprising:

an athletic shoe including a sole having forward and rearward downwardly facing tread surfaces spaced apart by a cavity formed upwardly into said sole;

a unitary plate formed with a top portion including a top surface configured to be complementally received in said cavity, a bottom portion underlying said top portion and having a lower surface formed with a plurality of spaced apart bearing surfaces constructed with a first coefficient of friction for slidably engaging said support surface, said plate further including a lateral side and a medial side configured with respective rails bowed outwardly centrally and further including upwardly projecting recesses within said plate, said sides being configured with a coefficient of friction higher than said first coefficient of friction for frictionally resisting sliding motion over the support surfaces;

a bonding agent for securing said top surface in abutting relationship with said cavity; and whereby the grinding apparatus may assume a first position wherein said bearing surfaces slidably engage the support surface and upon rolling about a longitudinal axis of said shoe assume an alternate position wherein one of said sides engages the support surface to frictionally resist a sliding motion over the support surfaces.

* * * * *